United States Patent [19]

Doi et al.

[11] 4,069,394

[45] Jan. 17, 1978

[54] STEREOPHONIC SOUND REPRODUCTION SYSTEM

[75] Inventors: Toshitada Doi, Yokohama; Hitoshi Wakabayashi, Kawasaki, both of Japan

[73] Assignee: Sony Corporation, Tokyo, Japan

[21] Appl. No.: 692,108

[22] Filed: June 2, 1976

[30] Foreign Application Priority Data

June 5, 1975 Japan ..... 50-67915

[51] Int. Cl.[2] ..... H04R 5/00

[52] U.S. Cl. ..... 179/1 G

[58] Field of Search ..... 179/1 G, 1 GQ, 100.4 ST, 179/100.1 TD, 15 BT

[56] References Cited

U.S. PATENT DOCUMENTS

| | | | |
|---|---|---|---|
| 3,214,519 | 10/1965 | Fouque | 179/1 G |
| 3,246,081 | 4/1966 | Edwards | 179/1 G |
| 3,249,696 | 5/1966 | Van Sickle | 179/1 G |
| 3,892,624 | 7/1975 | Shimada | 179/1 G |

FOREIGN PATENT DOCUMENTS

| | | | |
|---|---|---|---|
| 1,091,611 | 10/1960 | Germany | 179/1 G |

*Primary Examiner*—Douglas W. Olms

*Attorney, Agent, or Firm*—Lewis H. Eslinger; Alvin Sinderbrand

[57] ABSTRACT

In a stereophonic sound reproduction system in which stereophonic left and right signals are treated to have a level difference therebetween for establishing a localized sound image spaced from the midpoint between left and right loudspeakers, the level difference between such left and right signals is reduced as the frequency thereof increases for improving the localization of the sound image resulting from the application of the resulting or converted left and right signals to the left and right loudspeakers.

9 Claims, 14 Drawing Figures

STEREOPHONIC SOUND REPRODUCTION SYSTEM

BACKGROUND OF THE INVENTION

1. Field of the Invention

This invention relates generally to a stereophonic sound reproduction system, and more particularly to an improved stereophonic sound reproduction system which utilizes two loudspeakers.

2. Description of the Prior Art

In a prior art stereophonic sound reproduction system, it has been assumed that the location of the sound image of two channel stereophonic sound signals is limited to the range or region between the two loudspeakers and it has been assumed to be impossible to localize the sound image at positions outside the speakers. For this reason, a so-called quadraphonic system has been widely employed in which, for example, four speakers are located about a listener to reproduce a sound about the listener. This quadraphonic system, however, requires four audio-amplifiers and four loudspeakers, so that it becomes expensive.

It is said that a human listener can discriminate the direction of a sound arriving from his front or left and right relatively correctly, but it is difficult to discriminate the direction of a sound from in back of the listener.

Further, it has been also known to employ a so-called matrix sound system in two-channel stereophonic sound reproduction, in which a signal consisting of a stereophonic left signal combined with a small amount of a stereophonic right signal is supplied to a left speaker, and a signal consisting of the stereophonic right signal combined with a small amount of the stereophonic left signal is supplied to a right speaker, whereby the reproduced sounds from the left and right speakers are matrixed in a reproduction sound field so as to cause a listener to hear the sound as if it originated from positions outside of the two speakers. However, the sound reproduced by this system is rather unclear and hence a natural sounding localization can not be obtained by this system.

In general, in a two-channel stereophonic system, a technique is employed by which the sounds generated from two speakers are composed in a space to appear to be a sound which is emitted from just a single sound source. By way of example, when a sound is desired to be localized at the left-front of a listener, a speaker at the left side is supplied with a signal of relatively high level and a speaker at the right side is supplied with a signal of relatively low level. As described above, the localization of the sound reproduced in ordinary stereophonic sound reproduction systems depends upon the level difference between signals supplied to left and right speakers.

In fact, however, in nature, the direction of a sound generated from a single sound source and the distance between the sound source and a listener are sensed by the listener based upon the ratio between the complex sound pressures produced on the listener's left and right eardrums or the ratio between the absolute values of the sound pressures and also upon the difference between the phases of sounds. Accordingly, even if a single sound is recorded by, for example, a tape recorder and the recorded informations or sounds are reproduced through two speakers, the ratio between the sound pressures and the phase difference between the sounds produced on the eardrums of a listener are different from those experienced when the listener hears the original sound in nature and hence correct localization of the sound cannot be realized.

OBJECTS AND SUMMARY OF THE INVENTION

It is an object of the invention to provide a stereophonic sound reproduction system in which a level difference is provided between signals supplied to two loudspeakers for localizing the resulting sound image at a position spaced from the midpoint between the loudspeakers, and the level difference is reduced as the frequency of the signal is increased to clearly localize the sound image.

It is another object of the invention to provide a stereophonic sound reproduction system in which a level difference is provided between a first signal consisting of a left signal mixed with a suitable amount of a right signal and a second signal consisting of the right signal mixed with a suitable amount of the left signal, with a suitable amount of phase difference being provided between the first and second signals, and then the signals are supplied to the left and right loudspeakers, respectively so as to make it possible to clearly localize a sound image at a position other than in a region between the two loudspeakers.

It is a further object of the invention to provide a stereophonic sound reproduction system in which a circuit of simple construction is used to clearly localize a single composite sound within a range between two loud speakers and also within a range extending over an angle of at least 180° in front of a listener.

In accordance with an aspect of the present invention, there is provided a stereophonic sound reproduction system with input terminals to be supplied with stereophonic left and right signals provided with a level difference therebetween for defining a sound image spaced from the midpoint between a pair of loudspeakers, and a converting circuit connected to the input terminals and having a pair of output terminals to be connected to the pair of loudspeakers, the converting circuit including a circuit for reducing the level difference as the frequency of the signals is increased.

The above, and other objects, features and advantage of the present invention, will become apparent from the following description taken in conjunction with the accompanying drawings.

DESCRIPTION OF THE PREFERRED EMBODIMENTS

The present invention is based on the fact that, if two loudspeakers are excited in such a manner that they produce sounds whose complex sound pressure ratio is completely the same as the complex sound pressure ratio or the ratio between absolute values of sound pressures produced on a human listener's left and right eardrums by the sound wave from a single sound source, the listener will sense a natural synthesized sound localization (that is, the sounds from the two or more sound sources or loudspeakers are synthesized) not different from the sound from the signal sound source.

Figure 1A:
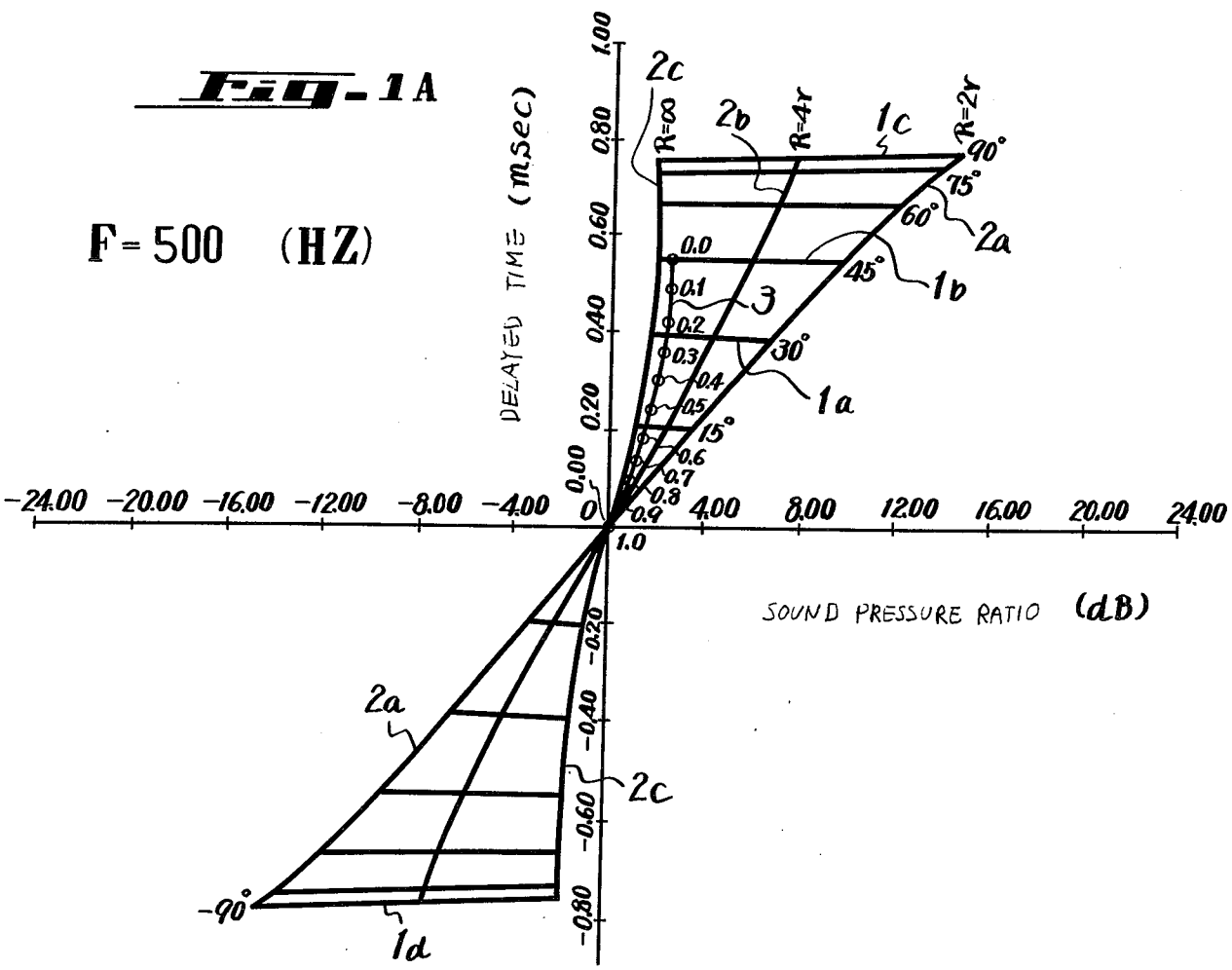
FIGS. 1A, 1B and 1C are graphs to which reference will be made in explaining sound image localization in a two-channel stereophonic system.

FIG. 1A shows the comparison of the complex sound pressure ratio on a listener's left and right eardrums when the listener hears the sound from a two channel stereophonic system with the complex sound pressure ratio on the listener's eardrums when the listener hears the sound from a single sound source. In this graph, the abscissa represents the sound pressure ratio of the absolute values in dB and the ordinate the delayed time difference (corresponding to phase difference) in millisecond.

In fact, the propagation of a sound wave through a human auditory canal can be assumed to be uniform regardless of the arriving direction of the sound wave, so that the values on both the abscissa and ordinate of FIG. 1A are those at the opening of the human auditory canal. In FIG. 1A, curves 1*a*, 1*b*, 1*c* and 1*d* respectively show traces of the complex sound pressure ratios at the listener's auditory canal when a single sound source is moved away from the listener's head to an infinite distance therefrom along paths at angles of 30°, 45°,90° and −90° from the direction extending forwardly from the listener's face. In this case, it is assumed that the angle $\theta$ of the sound source is 0° when the sound source is directly in front of the listener's face, that such angle is a positive angle ($+\theta$) when the sound source is to the right side of a position directly in front of the listener, and that the angle is a negative angle ($-\theta$) when the sound source is to the left side of the position directly in front of the listener. In FIG. 1A, curves 2*a*, 2*b* and 2*c* show traces of the complex sound pressure ratios when a single sound source is moved in circular paths about the listener's head at respective constant distances therefrom. The curves 2*a* and 2*b* shows the traces when the circular path of the sound source is at distances of 2 times and 4 times of the radius $\gamma$ of the listener's head, respectively, and the curve 2*c* shows the trace when the circular path of the sound source is at an infinite distance from the listener's head. Thus, in the case of a stereophonic sound reproduction system, if the complex sound pressure ratio of the synthesized sound on the listener's both eardrums is brought into the region bounded by the curves 2*a*, 2*c*, 1*c* and 1*d* in FIG. 1A, the listener can sense a natural sound image of the reproduced sound at the position corresponding to the single sound source both in distance and direction.

Figure 1B:
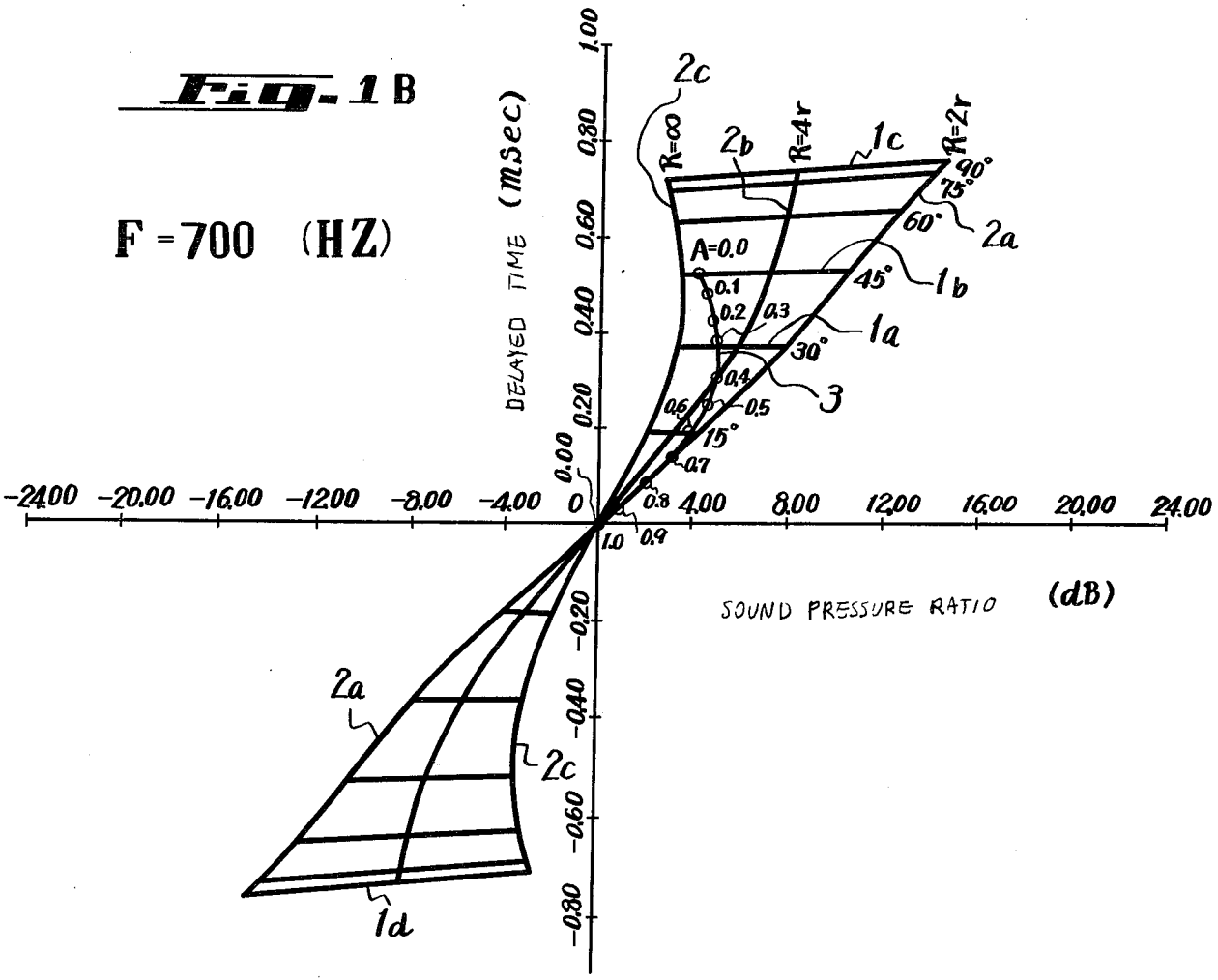
Figure 1C:
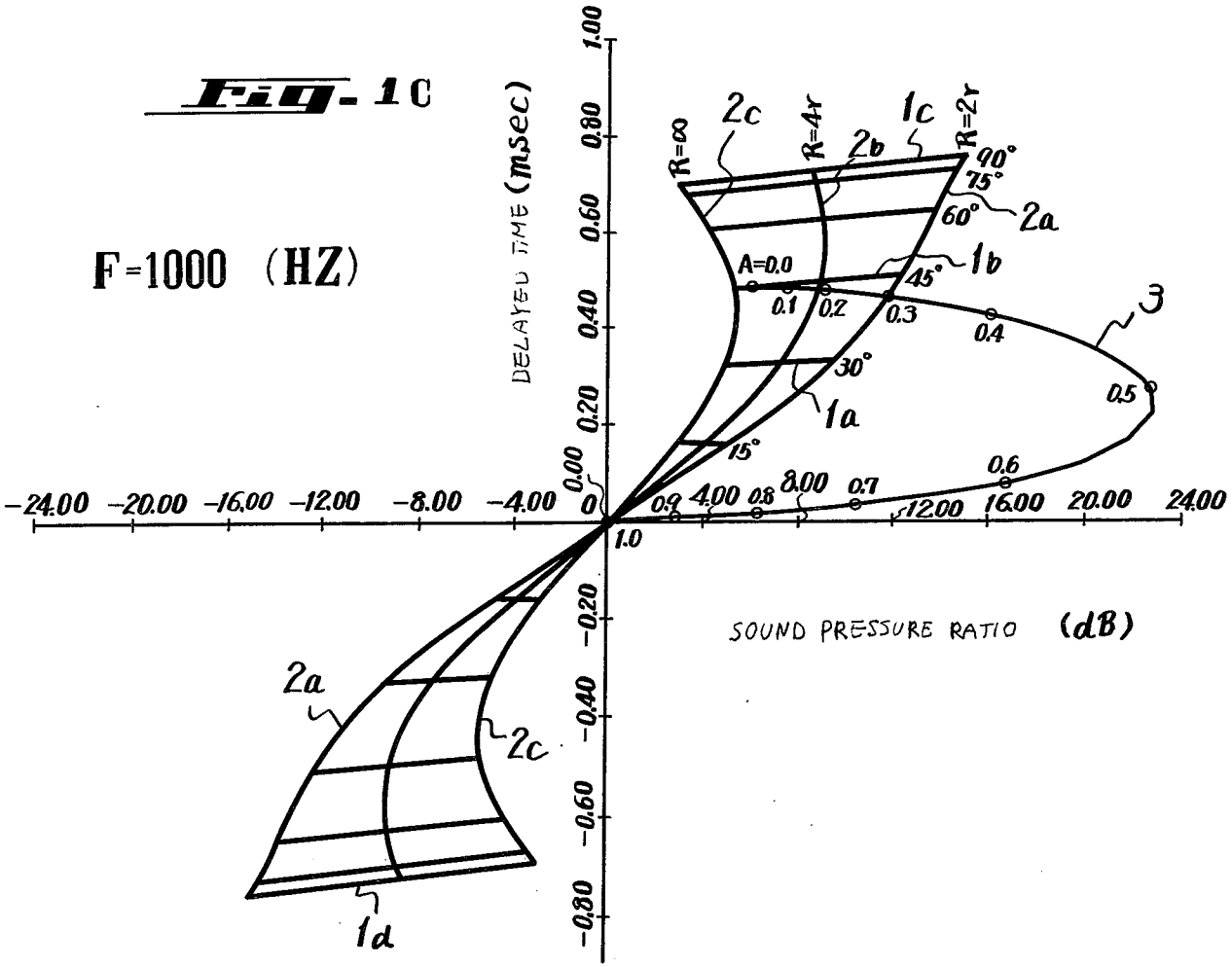

In the graphs of FIGS. 1A, 1B and 1C, curves 3 represent the trace of a synthesized sound image when two loudspeakers are used and the ratio $A$ of outputs from the left and right speakers is changed by the level difference localization used generally in an ordinary two-channel stereophonic system as follows:

$$A = \frac{\text{OUTPUT FROM LEFT SPEAKER}}{\text{OUTPUT FROM RIGHT SPEAKER}} = 0, 0.1, 0.2, \ldots 1.0$$

FIGS. 1A, 1B and 1C correspond to frequencies of 500 Hz, 700Hz and 1000 Hz, respectively.

As shown in FIG. 1A, when the frequency is 500 Hz, the sound image substantially moves on a line connecting the speakers in response to changes in the ratio $A$ between 0 and 1.0. In the case of the frequency of 700 Hz (FIG. 1B), the sound image moves to the front or closer to the listener as the ratio $A$ nears 1.0, that is, as the sound image approaches the midpoint between the louspeakers. However, the human ear is rather insensitive to distance so that listener does not feel unnatural. In the case of FIG. 1C or the frequency being 1000 Hz, the sound image is greatly displaced from the region corresponding to the single sound source, and the sound is distinctly sensed by the listener as being unnatural.

In the art it has been well known that the synthesized sound image is not as clear in its localization as a single sound source. One of the reasons therefor is that, in response to a level difference of the outputs from the left and right speakers, a complex sound pressure ratio, which is similar to that of the single sound source, is produced on the listener's eardrums only for a frequency lower than 700 Hz, but an unnatural sound image is produced for a frequency higher than 700 Hz. Further, even in the lower frequency range, the localization (distance and direction) of a sound image depends upon the frequency.

The present invention is effective to avoid the unnaturalness of the above localization and will be described with help of equations.

Figure 2:
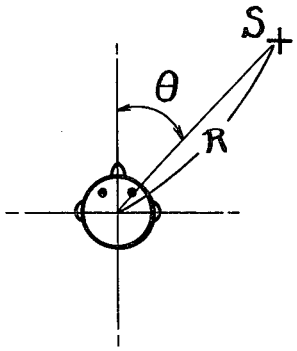
FIG. 2 is a diagram showing the positional relation between a listener's head and a sound source.

If it is assumed that the transfer functions of a sound source S to the entrances of auditory canals of listener's left and right eardrums are $D_L(R,\theta)$ and $D_R(R,\theta)$, and that the sound source S is located at a position which is at an angle $\theta$ in clockwise direction from the forward direction from the listener's face and a distance $R$ from the center of the listener's head, as shown on FIG. 2, the ratio $\gamma_a$ between such transfer functions, as expressed by the equation (1), corresponds to the complex sound pressure ratio.

$$\gamma a = \frac{D_R(R, \theta)}{D_L(R, \theta)} \tag{1}$$

Figure 3:
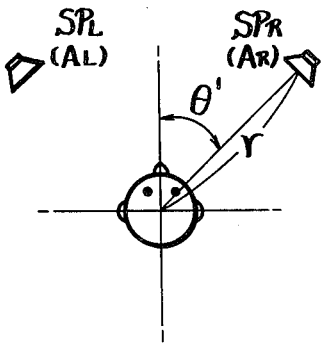
FIG. 3 is a diagram showing the positional relation between a listener's head and a loudspeaker.

On the other hand, as shown on FIG. 3, if left and right loud speakers $SP_L$ and $SP_R$ are excited with signals having the values of $A_L$ and $A_R$ (both of which are complex numbers), the complex sound pressure ratio $r_T$ between the listener's both eardrums is expressed as follows:

$$\gamma_T = \frac{A_R \cdot D_R(r, \theta') + A_L \cdot D_R(r, -\theta')}{A_L \cdot D_L(r, -\theta') + A_R \cdot D_L(r, \theta')} \tag{2}$$

where $r$ represents the distance from each of the speakers to the center of the listener's head and $\theta$ is the angle of the speaker from the forward direction. In this case it is assumed that both the speakers are positioned symmetrically with respect to the listener's head.

In order to make equation (1) coincident with equation (2) for any frequency, it is necessary that the speakers be excited to satisfy the following equation:

$$\alpha = \frac{A_R}{A_L} = \frac{D_L(R, \theta) \cdot D_R(r, -\theta') - D_R(R, \theta) \cdot D_L(r, -\theta')}{D_R(R, \theta) \cdot D_L(r, \theta') - D_L(R, \theta) \cdot D_R(r, \theta')} \quad (3)$$

Figure 4A:
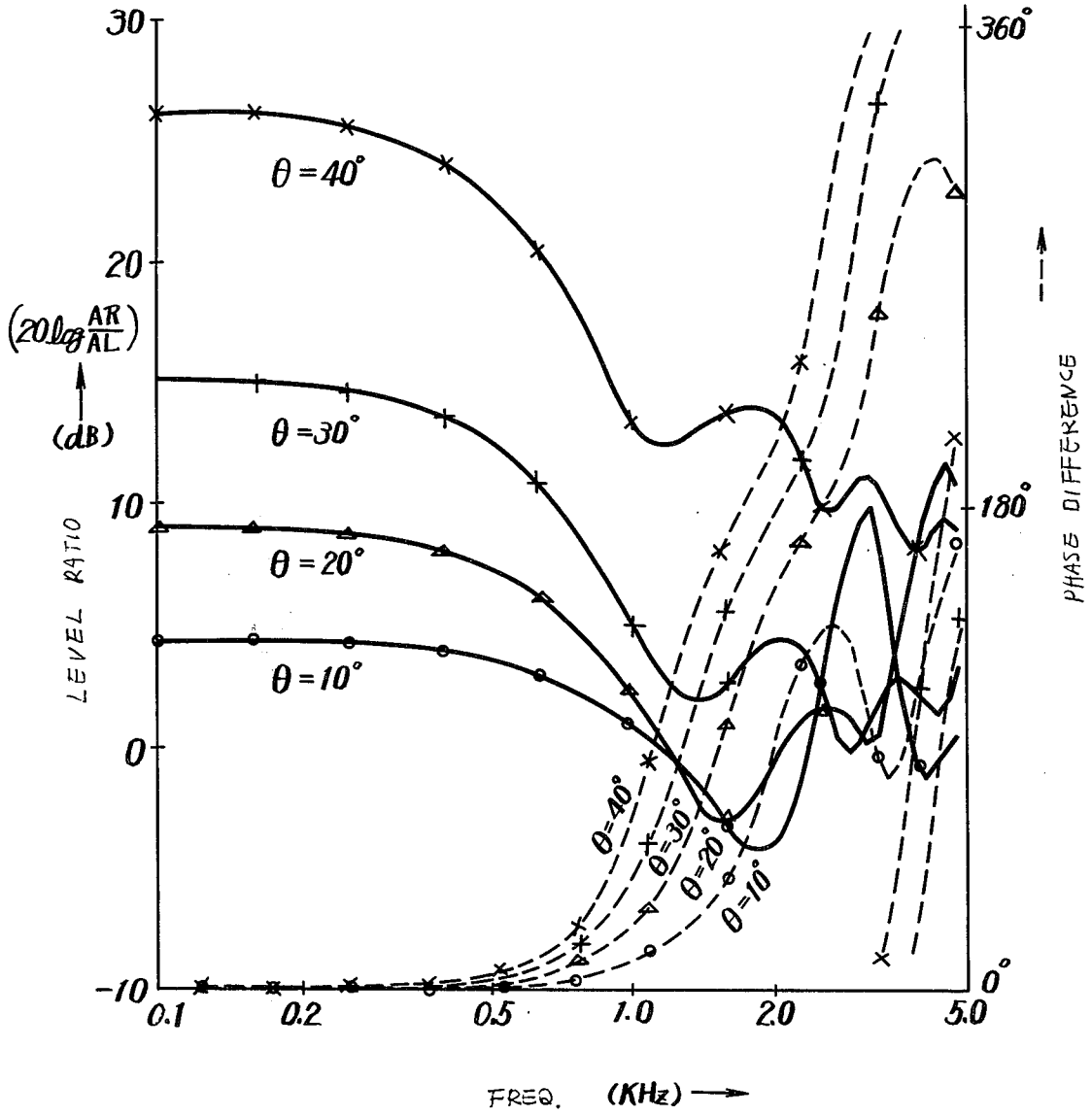
FIGS. 4A and 4B are graphs showing the relation among the level ratio, phase difference and frequencies of signals supplied to left and right loudspeakers for obtaining a natural sound image.

FIG. 4A shows the absolute values (solid lines) of equation (3) or the level ratio of signals $A_L$, $A_R$ to be supplied to the left and right speakers, and the displaced angle (dotted lines) or the phase difference (dotted lines) between the signals supplied to the left and right speakers (where $R = r = 2\sqrt{2}m$; $\theta' = 45°$; $\theta = 10°, 20°, 30°, 40°$; the listener's head is assumed to be symmetrically positioned with respect the left and right speakers; and $D_L(r, \theta) = D_R(R, -\theta)$).

By way of example, if it is desired that the sounds from two speakers will provide synthesized sound images localized along a line extending at an angle $\theta = 30°$, it will be apparent from FIG. 4A that the solution of equation (3) for that angle results in a ratio between the absolute values of signals $A_R$, $A_L$ to be supplied to the right and left speakers of about 15 d B for low frequencies (up to 300 Hz) and the ratio is reduced as the frequency is increased. For example, when the frequency is on the order of 1 KHz, the ratio is selected about 8dB. In this case, there is almost no phase difference between the signals supplied to the left and right speakers for frequencies below about 300 Hz, but as the frequency is increased beyond that value, a phase difference is required between both signals. For example, a phase difference of about 45° is required when the frequency is about 1 KHz. For other directions, for example, $\theta + 10°$, 20° or 40°, the same can be applied. If the level difference between the signals supplied to the left and right speakers is reduced as the frequency becomes high in accordance with equation (3), the sounds are localized within the region defined by the trace curves shown in FIGS. 1A to 1C and hence the distinct localization of the sound image can be obtained.

As shown in FIG. 4A, if the level difference between the signals supplied to the left and right speakers is varied in accordance with the frequency characteristics, a synthesized sound image of high frequency can be localized clearly.

Figure 4B:
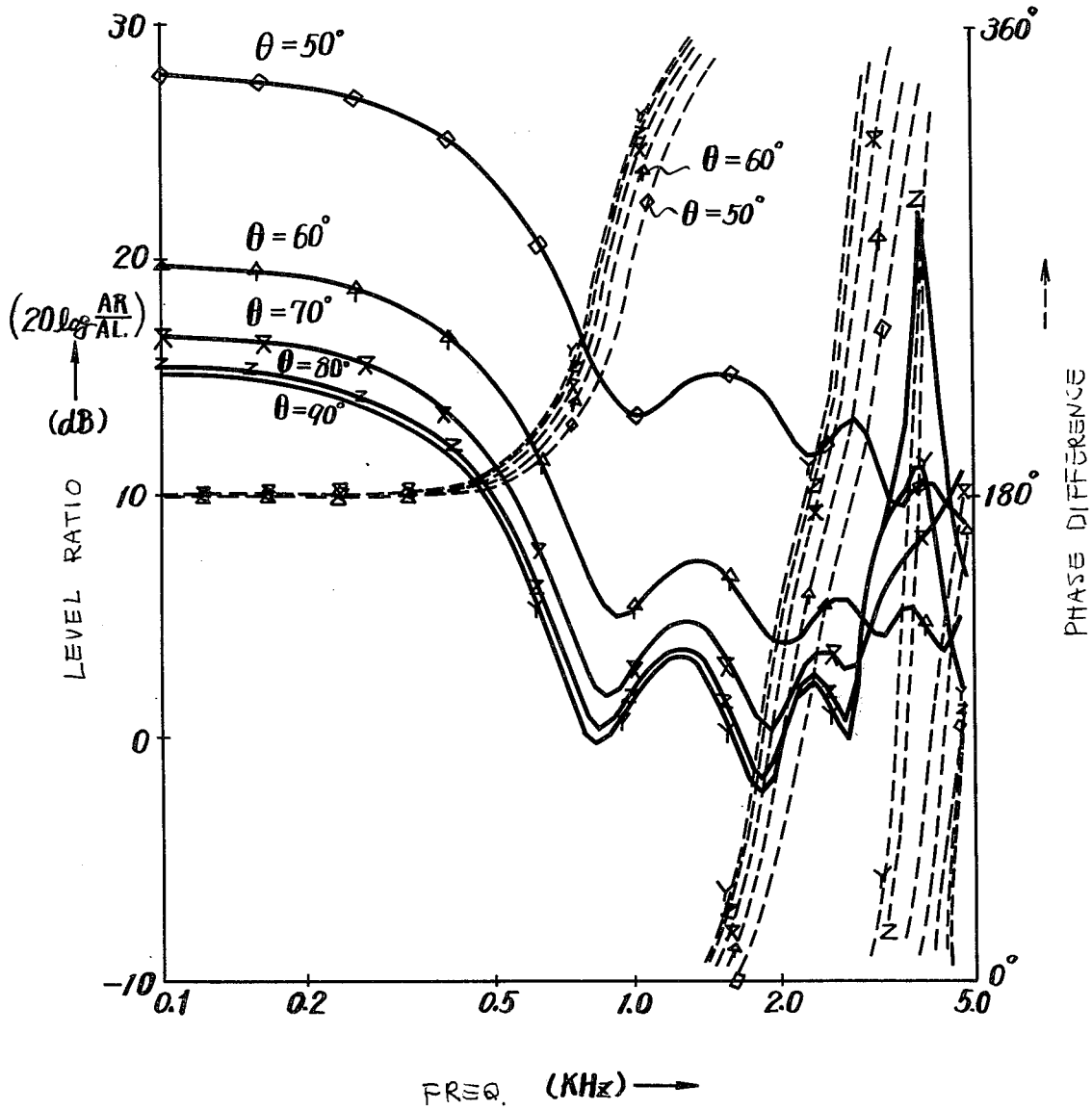

FIG. 4B shows the relation between the level difference of signals supplied to the left and right speakers and their frequency characteristics in case where the angle $\theta$ is being 50°, 60°, 70°, 80°, and 90°, respectively. As described, with the invention it is possible that the synthesized sound is localized at a portion where the angle $\theta$ is greater than 45°, that is, in areas other than that between the two speakers. In other words, as distinguished from the prior art two-channel stereophonic system, by varying the level difference with changes in frequency, it is possible to localize a sound image at positions outside the space between the speakers.

That is, with the invention the angle of localizing a sound image can be expanded as compared with the prior art to make it possible that a more wide stereophonic sound is obtained without increasing the number of transmission channels.

A practical embodiment of the invention, which will realize the above described object, will be now described.

Figure 5:
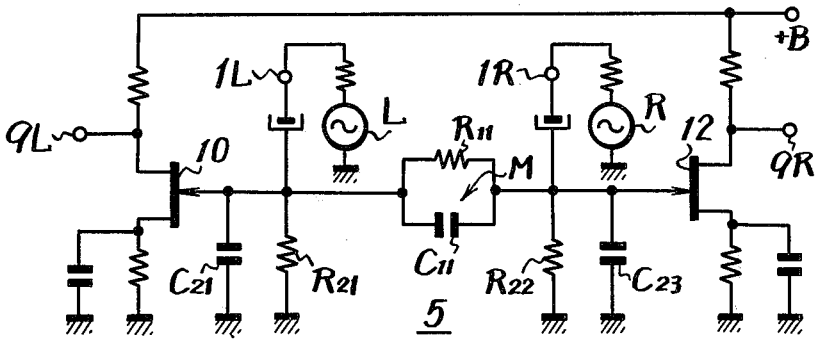
FIG. 5 is a circuit diagram of an embodiment of the invention for improving the localization of a sound image over a wide range.

FIG. 5 shows an apparatus or circuit according to the invention which improves the localization of a sound image. This circuit consists of input terminals 1L and 1R which are supplied with stereophonic left and right signals L and R, respectively; left and right output terminals 9L and 9R which are connected to left and right loudspeakers (not shown), respectively; and a converting circuit 5 which gives a phase difference and frequency characteristics to the left and right signals to be supplied to the speakers. In detail, the stereophonic left and right signals L and R are mixed a little by a circuit M formed of a resistor $R_{11}$ and a capacitor $C_{11}$ connected in parallel, then supplied to FET amplifiers 10 and 12, and delivered to the output terminals 9L and 9R, respectively. The extent to which the signals L and R are mixed by the circuit M increases as their frequency increases due to the capacitance of the capacitor $C_{11}$. Thus, the characteristic that the level difference between the signals applied to the left and right speakers is reduced as the frequency is increased, for example, as described in connection with FIG. 4A can be realized. The input impedances of the FET amplifiers 10 and 12 are set to be resembled by parallel connections of a resistor $R_{21}$ and capacitor $C_{21}$ and of a resistor $R_{22}$ and capacitor $C_{22}$, respectively. Resistors $R_{21}$, $R_{22}$ each have a resistance value which is sufficiently and capacitors $C_{21}$, $C_{22}$ each have a suitable capacitance so as to make the phase characteristics of the FET amplifiers 10 and 12 coincident with those shown in FIG. 4A.

With the circuit shown in FIG. 5, the signals L and R with a constant level difference between their left and right channels for a particular location of a sound image regardless of the frequency thereof are converted so that the level difference is reduced with increasing frequency as shown in FIG. 4A to make it possible that the sound image localization is improved in quality.

The circuit shown in FIG. 5 realizes the desired frequency-dependent change in the level difference shown in FIG. 4A up to the frequency of about 1 KHz, but it may be easily understood that if the RC circuit in the mixing circuit M is made multi-stage, the same characteristics are realized up to a higher frequency.

It is possible to apply the present invention to an ordinary stereophonic record or a stereophonic broadcast to perform specific effects. The stereophonic sound in the ordinary record or broadcast is obtained by a system in which a microphone is used for each singer or musical instrument and then the sound therefrom is divided to left and right channels with a suitable level difference therebetween. If such a sound signal is reproduced as it is, the sound image is localized between the speakers as described previously.

With the present invention it is also possible that the stereophonic sound signals of an ordinary two-channel system are expanded to a region extending over an angle of 180° between the left and right sides, as shown on FIG. 4B.

Figure 6:
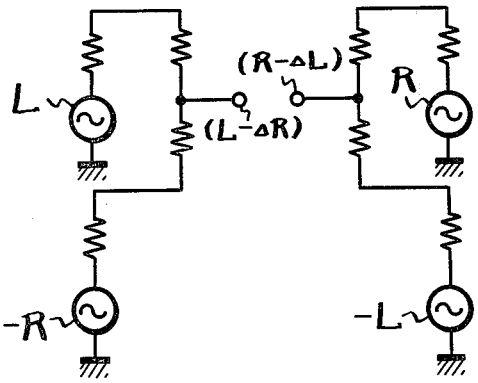
FIG. 6 is a circuit diagram to which reference will be made in explaining the theoretical basis for increasing the angle at which a sound image is localized.

FIG. 6 shows a circuit which converts an ordinary two-channel stereophonic sound signal into a signal providing a sound image that may be localized within the region extending over an angle of 180° between the left and right sides.

Figure 7A:
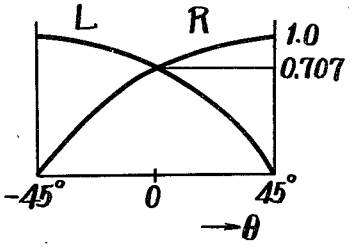
FIGS. 7A and 7B are graphs showing the relation between the levels of left and right signals supplied to left and right loudspeakers, respectively, and the angle at which the sound image is localized.
Figure 7B:
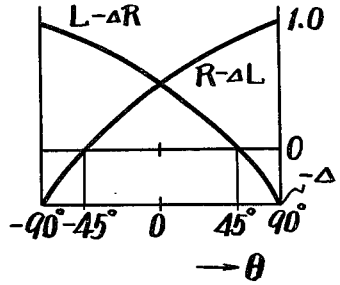

FIGS. 7A and 7B are graphs used for explaining the theory of the circuit of FIG. 6. When speakers are located at ±45° from the direction directly in front of a listener's head, the relationship between the position of a sound image and the outputs from the left and right speakers in the ordinary two-channel stereophonic system is shown in FIG. 7A. When the left and right signals L and R are equal in level, the sound image is localized at a position directly in front of the listener. When the level of the left signal L is 1.0 of the level of the right signal R is 0, the sound image is localized at the position of the left speaker or $\theta = -45°$.

On the other hand, when signals L − ΔR and R − ΔL ($0<\Delta<1$) are provided by means of the circuit shown in FIG. 6, the sound image localization in such a case is shown by the curves in FIG. 7B. If the signals supplied to the left and right speakers are provided with a phase difference of about 180°, as shown in FIG. 4B by dotted lines, and to have the level difference shown in FIG. 4B by solid lines, it becomes possible to localize the sound image at positions outside the space between the speakers. That is, when $R - \Delta L = 0.9$ and $L - \Delta R = 0$ in FIG. 7B, the sound image is localized at the position of the right speaker, and when $R - \Delta L > 0$ and $L - \Delta R < 0$, the sound image is localized at a position outside the right speaker. On the other hand, when $L - \Delta R > 0$ and $R - \Delta L > 0$, the sound image is localized at positions between the left and right speakers as in an ordinary stereophonic system. Finally, when $R - \Delta L < 0$ and $L - \Delta R < 0$, the sound image is localized at a position outside the left speaker.

According to FIG. 4B, the sound image is localized at ±90°, when $20 \log R - \Delta L / L - \Delta R = |15|$dB. However, the inventors of the present invention found by experiments that good results are obtained within the range of $20 \log \Delta R - \Delta L / L - \Delta R = |7 \sim 15|$dB.

Figure 8:
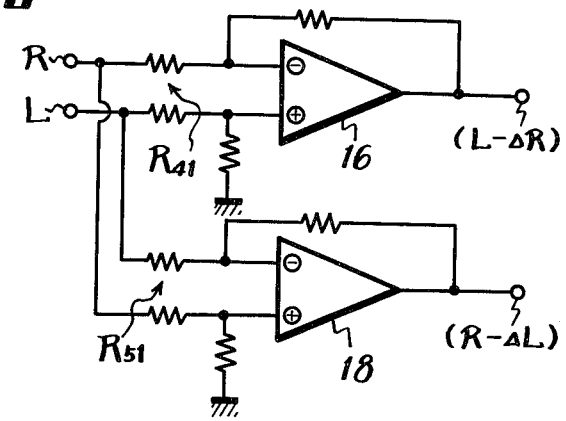
FIG. 8 is a circuit diagram of another embodiment of the invention for increasing the angle at which a sound image is localized.

FIG. 8 shows a practical circuit for obtaining $R - \Delta L$ and $L - \Delta R$. With the circuit of FIG. 8, the left and right stereophonic signals L and R are supplied through a resistor group $R_{41}$ to the normal and inserted inputs of a first operational amplifier 16 and also through a resistor group $R_{51}$ to the inverted and normal inputs, respectively, of a second operational 18, with the value of the above-mentioned Δ being determined by the resistance values of the registor groups $R_{41}$ and $R_{51}$. Then, output signals L − ΔR and R − ΔL to be supplied to the left and right speakers (not shown) are obtained at the output terminals which are led out from the operational amplifiers 16 and 18, respectively.

The circuits shown in FIGS. 6 and 8 have no frequency dependency in their conversion characteristics, that is, the ratio $R - \Delta L / L - \Delta R$ does not vary with frequency, so that they are effective only in a low frequency range, as shown in FIGS. 4A and 4B and the quality of the sound image provided thereby is the same as that provided by an ordinary two-channel stereophonic system.

Figure 9:
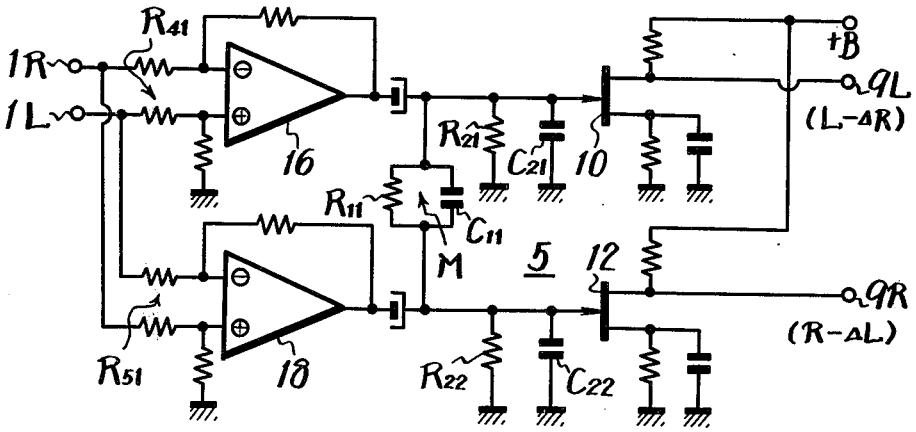
FIG. 9 is a circuit diagram of still another embodiment of the invention for increasing the angle at which a sound image is localized and for increasing the localization sense.

FIG. 9 shows a circuit according to the present invention which provides a reduced level difference between the left and right signals as their frequency becomes high so as to expand the possible positions of the sound image of the ordinary two-channel stereophonic signals to the region of $\theta = \pm 90°$. In the circuit of FIG. 9, the left and right signals L and R applied to its input terminals 1L and 1R are supplied to operational amplifiers 16 and 18 through resistor groups $R_{41}$ and $R_{51}$, respectively, as in FIG. 8; the outputs from the operational amplifiers 16 and 18 are mixed to an extent dependent on frequency by the mixing circuit M consisting of the resistor $R_{11}$ and the capacitor $C_{11}$ as in the circuit of FIG. 5, and further given a phase relation dependent on frequency by time constant circuits consisting of resistors $R_{21}$, $R_{22}$ and capacitors $C_{21}$, $C_{22}$, respectively, and then supplied to FET amplifiers 10, 12, respectively. In FIG. 9, the reference numerals 9L and 9R designate output terminals of the circuit to be connected to the left and right speakers (not shown), and the reference numeral 5 generally designates the converting circuit.

The operation of the circuit shown in FIG. 9 will be apparent from the description given above in connection with the circuits shown in FIGS. 5 and 8.

Figure 10:
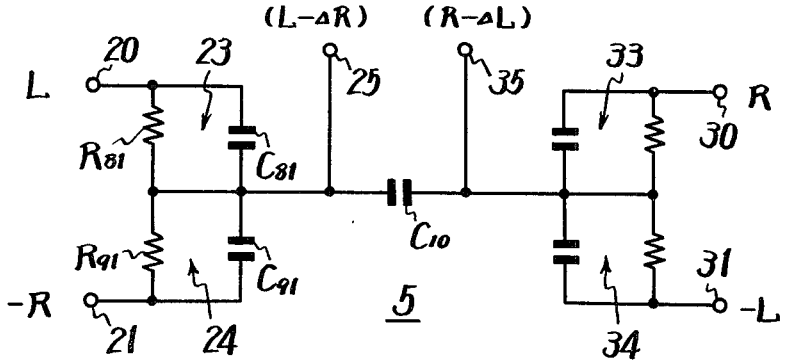
FIG. 10 is a circuit diagram of a further embodiment of the invention.

FIG. 10 shows another example of the invention which expands the sound image of an ordinary two-channel stereophonic signal in the region of ±90°.

In the circuit of FIG. 10, input terminals 20 and 21 are supplied with the left signal L and a signal −R reverse from the right signal R in phase, respectively, and the signals L and −R are mixed with each other through a first frequency characteristic adding circuit (time constant circuit) 23, which consists of a resistor $R_{81}$ and a capacitor $C_{81}$, and a second frequency characteristic adding circuit (time constant circuit) 24, which consists of a resistor $R_{91}$ and a capacitor $C_{91}$, respectively. In this case, the resistance values and capacitance values are selected to satisfy the conditions $R_{81} < R_{91}$ and $C_{81} < C_{91}$, respectively. The mixed output signal $L - \Delta R$ is delivered to an output terminal 25. The right side circuit has a pair of input terminals 30 and 31, which are supplied with the right signal $R$ and an reverse phase signal −L of the left signal L, respectively; first and second frequency characteristic adding circuits 33 and 34 which are the same in circuit construction as the first and second frequency characteristic adding circuits 23 and 24; and an output terminal 35 to which the signal $R - \Delta L$ is delivered. The output terminals 25 and 35, which are connected to the speakers (not shown), are coupled by a capacitor $C_{10}$ through which the signals $L - \Delta R$ and $R - \Delta L$ are mixed to an extent dependent on frequency. In FIG. 10, the reference numeral 5 generally indicates the converting circuit.

With the circuit shown in FIG. 10, since the signals supplied to the second frequency characteristic adding circuits 24 and 34 are great in phase-rotation as compared with the signals supplied to the first frequency characteristic adding circuits 23 and 33, respectively, it is possible that, especially in the high frequency range, the frequency characteristics shown in FIG. 4B are obtained.

It will be apparent that many modifications and variations could be effected in the above described specific embodiments of the invention by one skilled in the art without departing from the spirit or scope of the invention, so that the scope of the invention should be determined by the appended claims.

We claim as our invention:

1. In a stereophonic sound reproduction system having a pair of spaced apart left and right loudspeakers and providing stereophonic left and right signals with a level difference therebetween for producing a sound image localized at a position spaced from the midpoint between said loudspeakers when said stereophonic left and right signals are respectively applied to said left and right loudspeakers; a converting circuit comprising left and right input terminals respectively receiving said stereophonic left and right signals, left and right output terminals connected with said left and right loudspeakers, respectively, means for transmitting said left and right signals from said left and right input terminals to said left and right output terminals, respectively, and frequency responsive means for reducing the level difference between said left and right signals, as transmitted to said left and right output terminals, in response to increases in the frequency of said signals so as to improve the localization of the resulting sound image.

2. A stereophonic sound reproduction system according to claim 1; in which said converting circuit further comprises means for varying the phase relation of said left and right signals, as transmitted to said left and right output terminals, in response to changes in the frequency of said signals.

3. A stereophonic sound reproduction system according to claim 2; in which said means for transmitting the left and right signals includes left and right signal amplifiers having respective inputs connected to said left and right input terminals and respective outputs connected to said left and right output terminals, and said means for varying the phase relation of the left and right signals includes a first parallel circuit of a resistor and capacitor connected to the input of said left signal amplifier and a second parallel circuit of a resistor and capacitor connected to the input of said right signal amplifier.

4. A stereophonic sound reproduction system according to claim 3; in which said frequency responsive means for reducing the level difference includes a parallel circuit of a resistor and capacitor connected between said left and right input terminals.

5. A stereophonic sound reproduction system according to claim 1; in which said frequency responsive means for reducing the level difference includes a parallel circuit of a resistor and capacitor connected between said left and right input terminals.

6. A stereophonic sound reproduction system according to claim 1; in which said means for transmitting said left and right signals includes first and second operational amplifiers, said first operational amplifier having normal and inverted inputs receiving said left and right signals, respectively, from said left and right input terminals, and said second operational amplifier having normal and inverted inputs receiving said right and left signals, respectively, from said right and left input terminals.

7. A stereopnonic sound reproduction system according to claim 6; in which said means for transmitting the left and right signals further includes left and right signal amplifiers having respective inputs connected to the outputs of said first and second operational amplifiers, respectively, and said left and right signal amplifiers have respective outputs connected to said left and right output terminals, respectively.

8. A stereophonic sound reproduction system according to claim 1; further comprising first mixing means for mixing said left signal with a signal which is reversed in phase in respect to said right signal, and second mixing means for mixing said right signal with a signal which is reversed in phase in respect to said left signal, and in which said means for transmitting the left and right signals conducts the mixed outputs of said first and second mixing means to said left and right output terminals, respectively.

9. A stereophonic sound reproduction system according to claim 8; in which each of said first and second mixing means includes a first frequency characteristic adding circuit consisting of a resistor and a capacitor connected in parallel, and a second frequency characteristic adding circuit consisting of a resistor and a capacitor connected in parallel.

* * * * *